United States Patent [19]

Dakin

[11] 4,350,473

[45] Sep. 21, 1982

[54] LIQUID COOLED COUNTER FLOW TURBINE BUCKET

[75] Inventor: James T. Dakin, Schenectady, N.Y.

[73] Assignee: General Electric Company, Schenectady, N.Y.

[21] Appl. No.: 123,519

[22] Filed: Feb. 22, 1980

[51] Int. Cl.[3] ..... F01D 5/18

[52] U.S. Cl. ..... 416/1; 416/92; 416/96 R; 415/121 A; 415/168

[58] Field of Search ..... 415/115, 121 A, 168; 416/92, 96 R, 97 R, 1

[56] References Cited

U.S. PATENT DOCUMENTS

| | | | |
|---|---|---|---|
| 3,051,438 | 8/1962 | Roberts et al. | 416/92 |
| 3,804,551 | 4/1974 | Moore | 416/97 R |
| 3,816,022 | 6/1974 | Day | 416/92 |
| 3,856,433 | 12/1974 | Grondahl et al. | 416/97 R |
| 3,902,819 | 9/1975 | Holchender et al. | 416/96 |
| 4,111,604 | 9/1978 | Kydd | 416/92 |
| 4,134,709 | 1/1979 | Eskesen | 416/97 R |
| 4,142,831 | 3/1979 | Dakin et al. | 416/97 R |
| 4,179,240 | 12/1979 | Kothmann | 416/96 R |
| 4,212,587 | 7/1980 | Horner | 416/97 R |

FOREIGN PATENT DOCUMENTS

| | | |
|---|---|---|
| 979634 | 1/1965 | United Kingdom . |
| 1548154 | 7/1979 | United Kingdom . |

*Primary Examiner*—Robert E. Garrett

*Attorney, Agent, or Firm*—Lawrence D. Cutter; James C. Davis, Jr.; Marvin Snyder

[57] ABSTRACT

Means and a method are provided whereby liquid coolant flows radially outward through coolant passages in a liquid cooled turbine bucket under the influence of centrifugal force while in contact with countercurrently flowing coolant vapor such that liquid is entrained in the flow of vapor resulting in an increase in the wetted cooling area of the individual passages.

13 Claims, 4 Drawing Figures

LIQUID COOLED COUNTER FLOW TURBINE BUCKET

BACKGROUND OF THE INVENTION

This invention relates generally to a liquid cooled turbine bucket and more particularly to such a bucket cooled by directly contacting countercurrent flows of liquid and vapor.

Ultrahigh temperature(UHT) gas turbines operate in a range from 2500° F. to 3500° F., with the objective of providing as much as 200% more power and achieving as much as 50% greater thermal efficiency than conventional gas turbines. Materials employed in the manufacture of such turbines and the operating conditions therein dictate that the turbine buckets thereof be provided with liquid cooling.

A suitable method for liquid cooling ultrahigh temperature gas turbine buckets is that afforded by open circuit liquid cooled bucket constructions such as are shown in U.S. Pat. Nos. 3,804,551(Moore), 3,856,433(Grondahl et al), and 4,111,604(Kydd), for example, all of which are assigned to the assignee hereof. In typical open circuit water cooled buckets, tests have established that under preferred conditions of operation, (e.g. rate of water input, rotating speed, a temperature of motive fluid, etc.) the water travel in a thin film through each coolant passage, the axis of the passage being oriented approximately perpendicular to the turbine axis of rotation. The water film is pulled through the channel by centrifugal force, achieving high radial velocity. At the same time, the film experiences a strong Coriolis force, which, at operational rates of cooling water supply, pushes the liquid film into a limited transversely extending area (or corner) of the coolant passage.

When this occurs, the liquid film covers or wets but a small fraction of the total-surface area of the coolant passage and the cooling capacity of the liquid flow is accordingly reduced. For a given heat flow for each coolant passage this limited wetted cooling area results in a higher coolant passage surface temperature and in turn results in a higher bucket skin temperature and shortened bucket life. It would be most desirable to increase the effective wetted cooling area within each coolant passage at any given rate of liquid coolant flow whereby the bucket skin temperature can be reduced and the cycle life extended.

Several patents have been directed to this problem including the following issued Dakin et al and assigned to the assignee hereof: U.S. Pat. Nos. 4,090,810; 4,119,390; and 4,142,831. These patents typically include means disposed in the coolant passages themselves for dispersing radially outward flowing liquid coolant over a greater portion of the passage, thereby increasing the effective wetted cooling area. However, the utilization of these inventions in a turbine bucket may complicate the manufacture thereof.

The beneficial employment of the coolant vapor generated during this passage cooling has been limited to its use in power augmentation as exemplified in U.S. Pat. No. 3,816,022(Day) in which vapor is exhausted from the bucket tip. Alternatively, U.S. Pat. Nos. 4,134,709(Eskensen), and 4,179,240 (Kothman) describe liquid cooled buckets in which vapor is exhausted at a radially inward portion thereof. However, no discussion or guidance is provided therein of any solution to the problem of increasing the effective wetted cooling area within coolant passages in a rotating system.

Accordingly, it is an object of the present invention to increase the effective wetted cooling area of individual coolant passages in a liquid cooled turbine bucket.

A further object of the present invention is to employ the vapor generated during passage cooling to increase the effective wetted cooling area thereof.

Still another object of the present invention is to provide a turbine bucket with increased wetted cooling area having cooling passages that are relatively simple to manufacture.

SUMMARY OF THE INVENTION

The above objects and advantages are achieved in a means and a method for cooling a turbine bucket in which liquid is caused to flow in a substantially radially outward direction through coolant passages in a bucket airfoil-shaped portion. Vapor generated from the liquid during bucket cooling is caused to flow in a directly contacting countercurrent relationship with the liquid, entraining a portion of the liquid as through interfacial shear, resulting in the entrained liquid wetting additional coolant passage surface area. Flow dispersing means are included in a preferred embodiment, increasing the amount of liquid available for entrainment by the vapor.

BRIEF DESCRIPTION OF THE DRAWING

For better understanding of the invention reference may be had to the accompanying drawing wherein.

DESCRIPTION OF THE INVENTION

Figure 1:
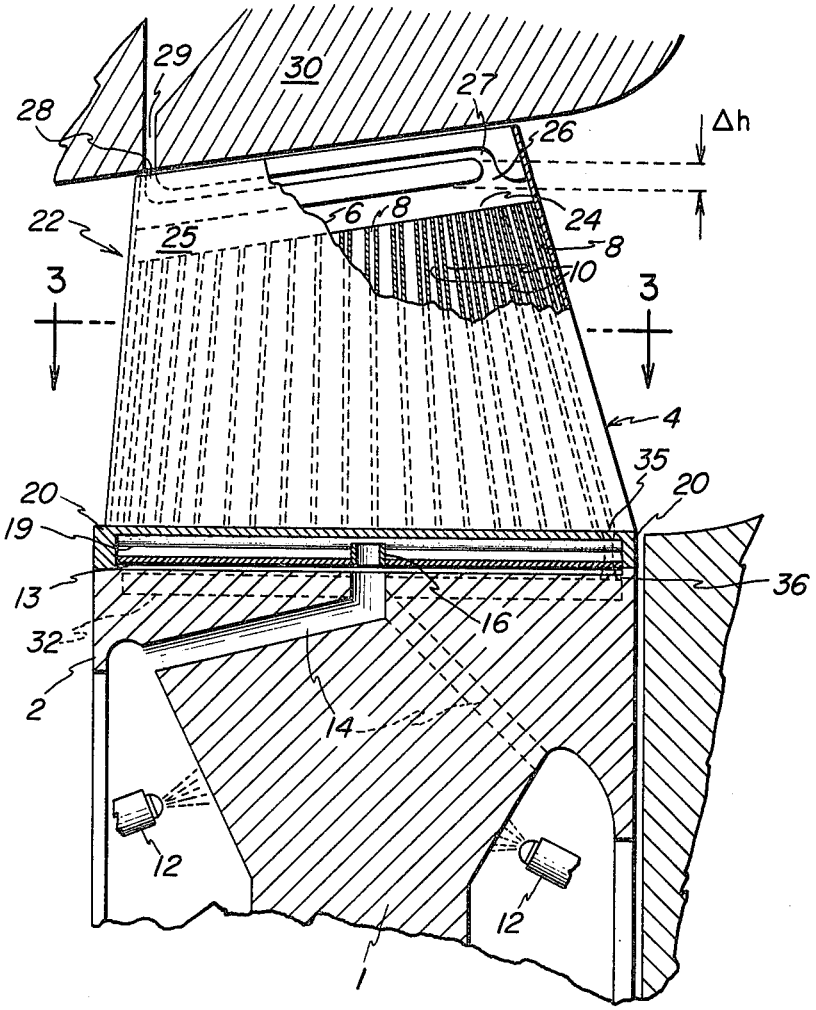
FIG. 1 is a transverse sectional view showing a gas turbine rotor disk rim and a liquid cooled turbine bucket constructed in accordance with an embodiment of the present invention taken along line 1—1 of FIG. 2.
Figure 2:
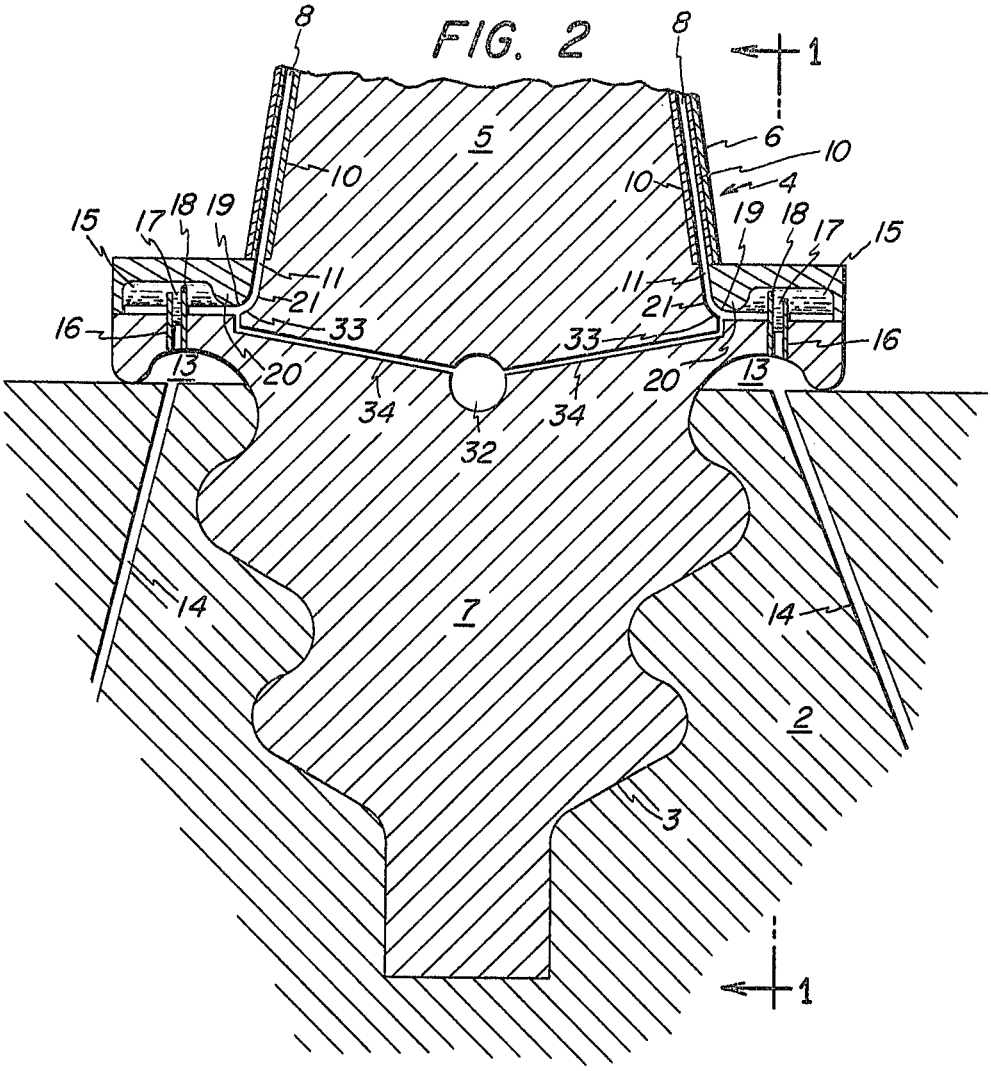
FIG. 2 is a sectional view of the turbine bucket depicted in FIG. 1 taken along a plane perpendicular through the axis of rotation of an associated turbine rotor.
Figure 3:
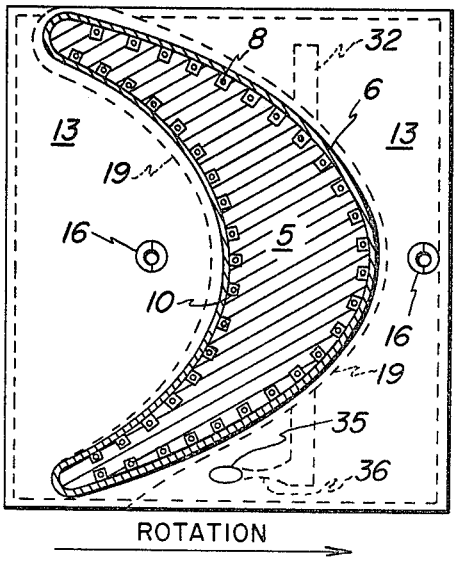
FIG. 3 is a sectional view of the turbine bucket of FIG. 1 taken along the line 3—3 in FIG. 1.

Referring generally to FIGS. 1, 2 and 3, a turbine wheel or disk 1 including a rim portion 2 is provided with dovetail shaped slots 3 machined therein in a generally transverse direction. As depicted, a turbine bucket 4 includes a central core 5 and an overlying outer skin 6 having an aerodynamic shape as best illustrated in FIG. 3. The bucket skin may be of the type disclosed in U.S. Pat. No. 4,091,146(Darrow et al) and assigned to the assignee hereof. The turbine bucket 4 also includes a root portion 7 which is received in the similarly configured dovetailed slot 3 for the firm mounting of the bucket to the disk. This mounting arrangement forms no part of the present invention and it will be understood that alternate mounting arrangements such as the tine and groove construction disclosed in U.S. Pat. No. 3,804,551(Moore) assigned to the assignee hereof may also be employed.

Coolant passages 8 extend in a generally radial direction in the bucket airfoiled shaped portion. As illustrated, coolant passages 8 are cylindrical preformed tubes set in a copper matrix 10 within grooves formed on the bucket central core 5 in the manner described in U.S. Pat. No. 4,156,582(Anderson) assigned to the assignee hereof. However, it will be appreciated that the present invention is not limited to a particular coolant passage configuration or particular arrangement for incorporating such passages in the bucket construction. Thus, for example, the present invention is also applicable to a monolithic bucket construction having coolant passages drilled therein a radial direction sub-adjacent the outer surface thereof. However, it is appreciated that coolant passages of substantially circular cross-section are preferable in the practice of the present invention since their curved contour facilitates the spreading of liquid coolant therethrough, thereby enabling a greater portion of the coolant passage to be wetted.

Liquid is admitted into a radially inward section 11 of the coolant passages 8 by a means for admitting liquid. Suitable means for admitting liquid are disclosed and claimed in U.S. Pat. Nos. 3,804,551 to Moore and 3,844,679 to Grondahl et al both of which are assigned to the assignee hereof. As depicted in FIGS. 1 and 2 liquid such as water is supplied from a coolant source including sprayers 12 to gutters 13 via passages 14 extending through the rim to the turbine disk. Gutters 13 are in flow communication with pools 15 of liquid coolant via liquid conducting tubes 16 having discharge ends 17 with positioning deflection tips 18 as more fully described in Moore ('551) as noted hereinabove. Weirs 19 are formed integral with platform elements 20 affixed to the bucket core 5. The pools 15 of liquid coolant are in flow communication with individual coolant passages 8 through a plurality of conduits 21 formed in part by the surfaces of weirs 19 and the bucket central core 5.

Coolant which is metered to the individual coolant passages 8 flows therethrough under centrifugal force in a radially outward direction towards a tip region 22 of the bucket. Means for discharging liquid coolant from the bucket are disposed in flow communication with radially outward sections 24 of the coolant passages 8. Such liquid discharging means includes a means for restricting the flow of vapor from the coolant passages into the liquid discharging means. In the exemplitive embodiment depicted in FIG. 1 the means for discharging liquid includes a liquid manifold 25 located in a bucket tip region 22 in flow communication with the radially outward ends of coolant passages 8. The flow of vapor into the liquid discharging means is restricted in this embodiment by a liquid trap 26. A suitable liquid trap is disclosed and claimed in U.S. Pat. No. 4,111,604 to Kydd assigned to the assignee hereof. The liquid trap 26 includes a slot 27 formed in the central core 5 of the turbine bucket. The slot 27 is in flow communication with both the liquid manifold 25 and a liquid discharge orifice 28. The discharge orifice 28 is aligned with a liquid collection slot 29 provided in the turbine casing 30, with the collection slot receiving liquid coolant discharged from the orifice 28 for the collection and circulation thereof. In an alternative embodiment of the invention not herein illustrated the means for restricting the flow of vapor comprises a discharge orifice suitable for limiting the flow of liquid therefrom resulting in the formation of a head of liquid which restricts the flow of vapor into the liquid discharging means.

As is best illustrated in FIG. 2, the turbine bucket is also provided with a means for discharging vapor therefrom. In the illustrated embodiment, the means includes a manifold 32 connected to individual radially inward sections 33 of coolant passages 8 by conduits 34. In the preferred embodiment the coolant passage sections 33 connected to the conduits 34 are located radially inward of that section of the coolant passages connected to the conduits 21 so as to facilitate the flow of liquid into the coolant passages as will be seen hereinbelow.

As best seen in FIG. 1 the means 31 for discharging vapor may also include a convergent-divergent nozzle 35 connected to the vapor manifold 32 by a conduit 36. The nozzle 35 is preferably disposed to exhaust vapor from the bucket in a direction so as to augment the power of the turbine. Thus, as illustrated in FIG. 3 the nozzle 35 is disposed to discharge vapor from the bucket in a rearward direction relative to the direction of rotation of the turbine disk 1. However, it will be understood that the present invention is not limited to an embodiment including a vapor discharge nozzle in the means 31 for discharging vapor. In an alternative embodiment not herein depicted vapor may be discharged from the bucket into a collection system through a conduit extending along the turbine disk as more fully described in U.S. Pat. No. 4,134,709 to Eskensen assigned to the assignee hereof.

Figure 4:
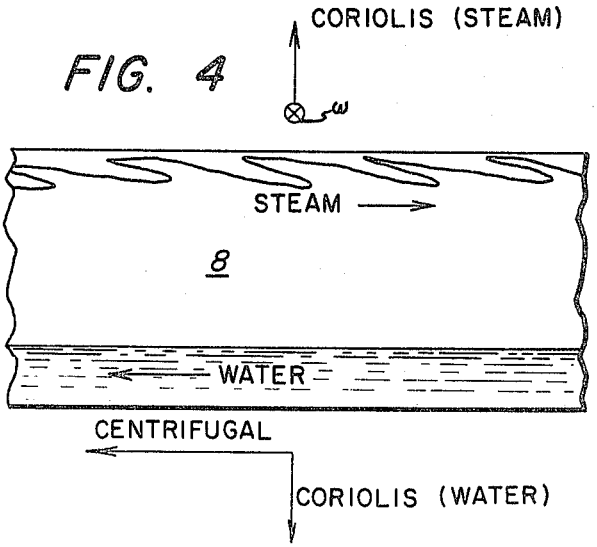
FIG. 4 is a sectional view of an individual coolant passage operating in accordance with the present invention.

In operation, a metered flow of liquid coolant such as water is admitted to the coolant passages 8 and is caused to flow therethrough in a radially outward direction by centrifugal force. As best is illustrated in FIG. 4 the coolant liquid flows along a limited area of the coolant passage 8 due to a Coriolis force induced by the rotation of the turbine disk 1 and the direction of the coolant flow. Upon reaching radially outward ends of the passages 8 the liquid enters liquid manifold 25 and flows radially outward therefrom into the liquid trap 26. Liquid coolant is then discharged from the turbine bucket through the orifice 28 into the turbine casing through the slot 29.

The dischage of vapor generated during the traversal of the liquid coolant through the passages 8 is restricted through the means for discharging liquid by the liquid trap 26. The vapor is thus forced to flow through the coolant passages 8 in a direction countercurrent to the water flow. Liquid is entrained in the vapor flow through an interfacial shear force between the two countercurrently flowing streams. Additional vapor entrainment may be obtained in an alternative embodiment of this invention in which liquid dispersing means such as those disclosed and claimed in U.S. Pat. No. 4,142,831 to Dakin et al and assigned to the assignee hereof are disposed in the coolant passages 8. These liquid dispersing means may include a plurality of indentations projecting outwardly from the inner periphery of the wall of an associated coolant passage in the liquid flow path. Droplets are formed as liquid flows over the liquid dispersing means, with the droplets thus generated becoming available for entrainment in the countercurrently flowing stream of vapor.

The direction of the Coriolis force is a function in part of the direction of travel of a flow stream of interest. Accordingly, since the vapor flow is traveling in a direction opposed to that of the liquid flow, the resulting Coriolis force on the vapor and on the entrained liquid has a substantially opposite direction to that of the liquid flow. Thus, as illustrated in FIG. 4 the liquid entrained in the vapor flow is forced against portions of the coolant passage walls previously unwetted by the liquid flow whereby the heat transfer capacity of the coolant channels is increased. Tests on a water cooled tubular assembly containing an embodiment of the present invention have exhibited an approximate 50% increase in the amount of heat transferrable while maintaining the assembly at a given temperature through the practice of the present invention.

The above described embodiments of this invention are intended to be exemplitive only and not limiting, and it will be appreciated from the foregoing by those skilled in the art and many substitutions, alterations and changes may be made to the disclosed structure without departing from the spirit or scope of the invention.

What is claimed as new and desired to be secured by Letters Patent of the United States is:

1. In a liquid cooled turbine bucket adapted for mounting on a rotatable turbine wheel and having a tip region at a radially outward end and an airfoil-shaped portion located radially inward to said tip region, the improvement comprising:

a plurality of radially extending coolant passages disposed in said airfoil-shaped portion;

means for admitting liquid into said passages at radially inwardly disposed sections of said passages;

means for discharging liquid from said bucket disposed in flow communication with radially outwardly disposed sections of said passages, said liquid discharging means including a means for restricting the flow of vapor from said passages into said liquid discharging means; and means for discharging vapor from said bucket disposed in flow communication with said passages at second radially inwardly disposed sections of said passages.

2. An improved liquid cooled turbine bucket as in claim 1 wherein said second radially inwardly disposed sections of said passages in flow communication with said vapor discharging means ae disposed radially inward of said passage sections disposed in flow communication with said liquid admitting means.

3. An improved liquid cooled turbine bucket as in claim 1 wherein said vapor discharging means includes a nozzle in vapor communication with at least a portion of said second passage sections and disposed to exhaust vapor from said bucket in a rearward direction relative to the direction of rotation of said turbine wheel.

4. An improved liquid cooled turbine bucket as in claim 3 wherein said vapor discharging means includes at least one vapor manifold in flow communication with at least a portion of said second passage sections and with said nozzle.

5. An improved liquid cooled turbine bucket as in claim 1 wherein said liquid discharging means includes a liquid manifold located in the bucket tip region in flow communication with radially outwardly disposed ends of said coolant passages and with an orifice for the discharge of liquid coolant from the turbine bucket.

6. An improved liquid cooled turbine bucket as in claim 5 wherein said liquid discharging means includes a liquid trap disposed in said tip region radially outward from and in communication with said liquid manifold intermediate said liquid manifold and said liquid coolant discharge orifice.

7. An improved liquid cooled turbine bucket as in claim 1 wherein said liquid passages are substantially circular in cross-section.

8. An improved liquid cooled turbine bucket as in claim 1 further comprising means disposed in said coolant passages for dispersing liquid flowing through said passages.

9. In a liquid cooled turbine bucket adapted for mounting on a rotatable turbine wheel and having a tip region at a radially outward end and an airfoil-shaped portion located radially inward of said tip region, the improvement comprising:

a plurality of radially extending coolant passages disposed in said airfoil-shaped portion;

means for admitting liquid into radially inwardly disposed sections of said passages;

means for discharging liquid from said bucket including a liquid manifold located in the bucket tip region in flow communication with radially outward ends of said coolant passages, and an orifice in communication with said liquid manifold for restricting the flow of vapor into said liquid discharging means and adapted for the discharging the liquid coolant from said bucket; and means for discharging vapor from said bucket including at least one vapor manifold in flow communication with radially inward ends of said coolant passages, and a nozzle in vapor communication with said vapor manifold and disposed to exhaust vapor in a rearward direction relative to the direction of rotation of said turbine wheel.

10. A method for cooling turbine buckets mounted on a turbine wheel and rotated about a turbine shaft, said buckets having a plurality of radially disposed coolant passages and a bucket airfoil-shaped portion, said passages terminating at their radially outward end adjacent a bucket tip region, said method comprising the steps of:

providing liquid coolant to radially inwardly disposed sections of said passages;

conveying liquid coolant radially upward through said passages by centrifugal force;

cooling a first arcuate portion of said coolant passage walls by contact with said conveyed liquid coolant and heating said liquid coolant by said contact whereby at least a portion of said liquid coolant transitions to a vapor phase;

restricting the flow of vaporized coolant into said bucket tip region;

discharging liquid coolant from said tip region;

conducting vaporized coolant radially inwardly through said coolant passages in contact with said conveyed liquid coolant;

providing a vapor discharge means disposed in communication with radially inwardly disposed ends of said passages; and discharging vaporized coolant from said vapor discharge means.

11. A method for cooling turbine buckets as in claim 10 wherein a portion of the liquid coolant is entrained in the conducted flow of vaporized coolant whereby a second accurate portion of said coolant passage walls is cooled by contact with said entrained liquid coolant.

12. A method as in claim 10 wherein further comprising the steps of:

dispersing the liquid coolant conveyed radially upward through said passages so as to generate liquid droplets;

entraining at least a portion of said liquid droplets in the flow of vaporized coolant conducted radially inward in said passages.

13. A method for cooling turbine buckets as in claim 10 in which said vaporized coolant is discharged from said vapor discharge means in a rearward direction relative to the direction of rotation of said turbine wheel.

* * * * *